US010202718B2

(12) United States Patent
Jo et al.

(10) Patent No.: US 10,202,718 B2
(45) Date of Patent: Feb. 12, 2019

(54) LAUNDRY TREATMENT APPARATUS

(71) Applicant: LG ELECTRONICS INC., Seoul (KR)

(72) Inventors: Mingyu Jo, Seoul (KR); Hyoungmin Sim, Seoul (KR); Seungjoon Kim, Seoul (KR); Seungchul Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 48 days.

(21) Appl. No.: 15/280,030

(22) Filed: Sep. 29, 2016

(65) Prior Publication Data

US 2017/0096761 A1 Apr. 6, 2017

(30) Foreign Application Priority Data

Oct. 1, 2015 (KR) ..... 10-2015-0138654

(51) Int. Cl.
*D06F 37/24* (2006.01)
*D06F 37/20* (2006.01)

(52) U.S. Cl.
CPC ..... *D06F 37/245* (2013.01); *D06F 37/203* (2013.01)

(58) Field of Classification Search
None
See application file for complete search history.

(56) References Cited

U.S. PATENT DOCUMENTS 6,389,628 B1 * 5/2002 Sears ..... D06F 37/245 68/23.2
2012/0144879 A1 6/2012 Verma
2013/0167596 A1 * 7/2013 Kang ..... D06F 37/20 68/12.06
2015/0233040 A1 * 8/2015 Kim ..... D06F 37/225 68/140

FOREIGN PATENT DOCUMENTS

EP 2025797 A1 2/2009
KR 10-1332285 B1 11/2013
KR 10-2014-0102014 A 8/2014
KR 10-2015-0098390 A 8/2015

OTHER PUBLICATIONS

Matsumoto Toshinari, DE-112014003801-T5, May 2016 (Year: 2016).*

* cited by examiner

*Primary Examiner* — Jason Y Ko
*Assistant Examiner* — Cristi J Tate-Sims
(74) *Attorney, Agent, or Firm* — Dentons US LLP

(57) ABSTRACT

Disclosed herein is a laundry treatment apparatus including balancers. The laundry treatment apparatus includes a cabinet 1 with a laundry feeding hole formed therein, a tub 10 provided within the cabinet and for holding washing water, a drum 20 installed within the tub for holding laundry, a driving unit to rotate the drum, a plurality of balancers 110 each having an internal space formed in the balancer in which water is received, the plurality of balancers spaced apart from each other on the circumference of the drum, and an inflow channel device 140 to selectively guide water from the outside of the drum to the internal spaces of the plurality of balancers when the drum is rotated.

16 Claims, 10 Drawing Sheets

LAUNDRY TREATMENT APPARATUS

CROSS-REFERENCE TO RELATED APPLICATION

Pursuant to 35 U.S.C. § 119(a), this application claims the benefit of earlier filing date and right of priority to Korean Patent Application No. 10-2015-0138654, filed on Oct. 1, 2015, the contents of which are incorporated by reference herein in their entirety.

BACKGROUND OF THE INVENTION

Field of the Invention

The present invention relates to a laundry treatment apparatus for reducing an eccentric amount of a drum and, more particularly, to a laundry treatment apparatus including a balancer capable of active control.

Discussion of the Related Art

A conventional laundry treatment apparatus includes a cabinet forming an external appearance, a tub included within the cabinet and for storing water, a drum rotatably provided within the tub for storing laundry, and a driving unit to rotate the drum.

The drum may be rotated without maintaining a dynamic equilibrium depending on laundry stored therein.

The dynamic equilibrium means "the state in which total moment generated by a centrifugal force or a centrifugal force becomes 0 with respect to the rotation axis when a rotating body is rotated". In the case of a rigid body, an ideal dynamic equilibrium is maintained if a mass distribution is constant around the rotation axis.

Such an ideal dynamic equilibrium, although it is practically impossible, may be considered to be an actual dynamic equilibrium state if a mass distribution of laundry is in a permissible range (if a drum is rotated while being vibrated within the permissible range) around the rotation axis of the drum when the drum is rotated in the state in which the laundry has been stored in the laundry treatment apparatus.

In contrast, the state in which an actual dynamic equilibrium has been broken (i.e., unbalance) in the laundry treatment apparatus is generated when the degree to which a mass distribution has become eccentric based on the rotation axis of the drum when the drum is rotated exceeds a permissible range.

The drum rotated in the unbalance state is vibrated along with rotation, and the vibration of the drum is delivered to the tub or the cabinet, causing noise.

In order to reduce such eccentricity of the drum, a conventional laundry treatment apparatus includes a ball balancer or fluid balancer having a ball or a fluid received in a housing fixed to the drum. In particular, a front loading type laundry treatment apparatus inclined toward the front, that is, the rotation axis of the drum has the fastest speed when laundry causing the eccentricity of the drum in the unbalance state passes through the lowest point of a drum rotation track and has the slowest speed when the laundry causing the eccentricity of the drum in the unbalance state passes through the highest point of the drum rotation track. Accordingly, the ball balancer or the fluid balancer included in the conventional laundry treatment apparatus functions to reduce eccentricity in such a manner that the ball or the fluid moves toward the lowest point of the drum rotation track when the laundry causing eccentricity moves toward the highest point.

SUMMARY OF THE INVENTION

A conventional method of reducing eccentricity is useful in a steady state in which the vibration of the drum is in a specific range, but has a problem in that a significant effect may not be expected in a transient state (or transient vibration), that is, the state before the vibration of the drum reaches the steady state. A first object of the present invention is to solve such a problem.

In a conventional technology, a point at which the ball balancer or the fluid balancer is located is limited to the front end of the drum, which may be useful in reducing eccentricity at the front end of the drum, but there is a problem in that it is difficult to reduce eccentricity at the rear end of the drum. A second object of the present invention is to propose means for reducing the entire eccentricity from the front end of the drum to the rear end of the drum.

In a conventional technology, there is a problem in that much power for rotating the drum is consumed if an eccentricity reduction is not required because a ball or fluid has been filled in the ball balancer or fluid balancer and thus weight of the filled ball or fluid is added to the drum. Furthermore, there is a problem in that there is a limit to the inclusion of a balancer having a capacity-hungry ball or fluid due to such a power problem. A third object of the present invention is to solve such a problem.

A fourth object of the present invention is to solve unbalance more positively and actively when the unbalance is generated.

A fifth object of the present invention is to enable an eccentricity reduction to be controlled more easily by allowing the balancer itself to lead the eccentricity of the drum to a designated location.

A laundry treatment apparatus according to an embodiment of the present invention includes a cabinet with a laundry feeding hole formed therein, a tub provided within the cabinet for holding washing water, a drum installed within the tub for holding laundry, a driving unit to rotate the drum, a plurality of balancers each having an internal space formed in the balancer in which water is received, the plurality of balancers spaced apart from each other on the circumference of the drum, and an inflow channel device to selectively guide water from the outside of the drum to the internal spaces of the plurality of balancers when the drum is rotated.

The laundry feeding hole may be formed at the front of the cabinet. The drum may be rotatably installed around the rotation axis which is inclined forward. The plurality of balancers may be provided to come into contact with the inside back of the drum. The inflow channel device guides the water so that the water flows from the back of the drum to the internal spaces of the plurality of balancers.

The plurality of balancers may be spaced apart from the front end of the drum, may be formed in a front and rear direction of the drum, and may be protruded in the direction opposite the centrifugal direction on the inner circumferential surface of the drum. In this case, each of the balancers may include an inclined portion in which the protrusion height of the rear end portion of the balancer is greater than the protrusion height of other portions of the balancer.

The plurality of balancers may be spaced apart from each other at intervals of the same angle around the rotation axis.

At least one of the plurality of balancers may include a lateral partition formed in the circumferential direction of the drum, to divide the internal space of the balancer front and back and to have a termination spaced apart from the inside surface of the internal space of the balancer in the direction opposite the centrifugal direction. The lateral partition may include a lateral partition groove formed in a centrifugal direction at the termination.

At least one of the plurality of balancers may include a vertical partition formed in the front and rear direction of the drum to divide the internal space of the balancer in the circumferential direction of the drum and to have a termination spaced apart from the inside surface of the internal space of the balancer in the direction opposite the centrifugal direction. The vertical partition may include a vertical partition groove formed in the centrifugal direction at the termination. Assuming that a plane on which the vertical partition is disposed is present, the inflow channel device may include a channel partition disposed on the plane. the channel partition divides an inflow hole formed at the termination of a channel within the inflow channel device.

The laundry treatment apparatus may further include an outflow channel to guide water so that the water flows out from the internal space of each balancer. The outflow channel may be formed in the back direction of each balancer. The laundry treatment apparatus may further include an outflow channel to guide water so that the water flows out from the internal space of each balancer. An outflow hole formed at the start end of the outflow channel may be disposed in the direction opposite the centrifugal direction with respect to an inflow hole formed at the point into which water flows from the inflow channel device to the internal space of the balancer.

At least one balancer may include an inclined portion protruded from the inner circumferential surface of the drum in the direction opposite the centrifugal direction so that a protrusion height of the rear end portion of the inclined portion greater than the protrusion height of other portions of the balancer. The protrusion height of the rear end of the balancer may be greater than a height from the inner circumferential surface of the drum to the outflow hole. The protrusion height of the front portion of the inclined portion may be less than a height from the inner circumferential surface of the drum to the outflow hole.

Water introduced through the inflow channel device may be supplied from the back of the drum, and water drained through the outflow channel may be discharged to the space between the drum and the tub.

DETAILED DESCRIPTION OF THE EMBODIMENTS

Figure 1:
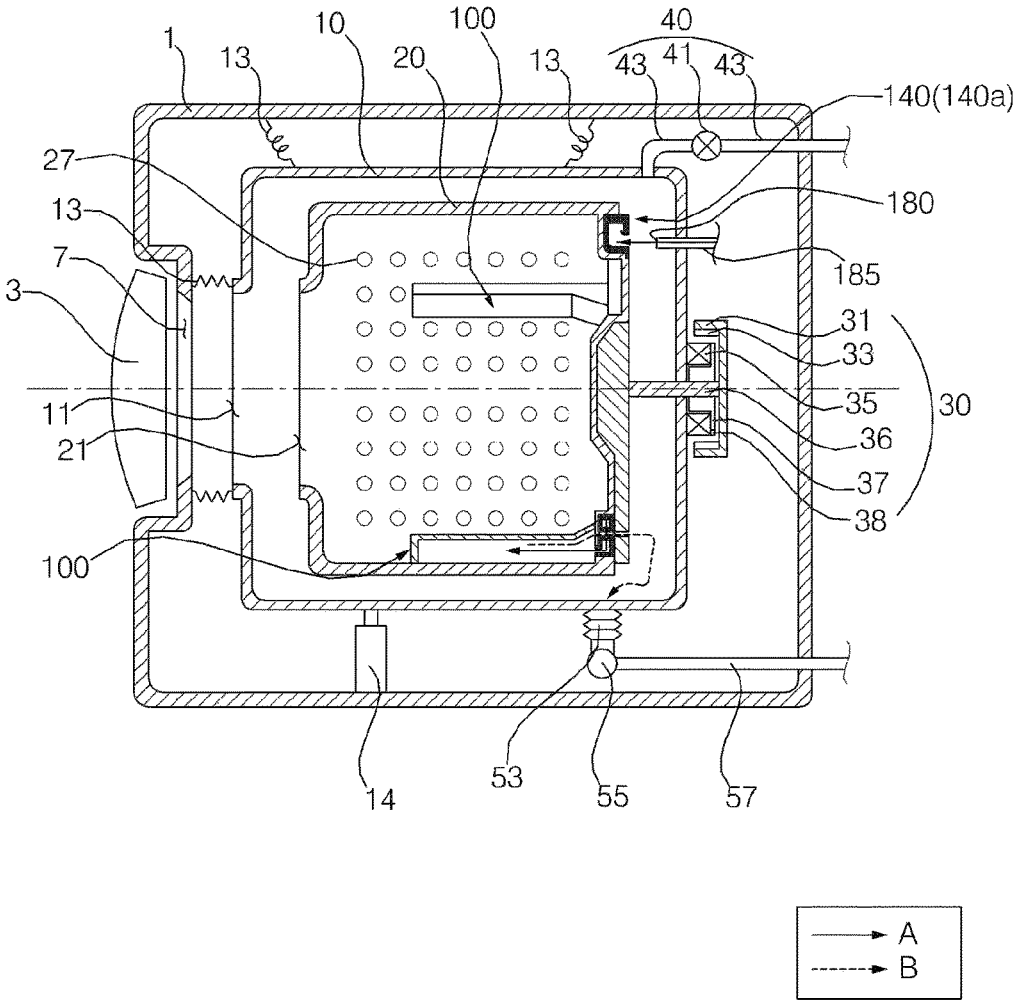
FIG. 1 is a conceptual diagram showing a lateral section of a washing machine which has been vertically cut in the front and rear direction according to an embodiment of the present invention.

In the entire specification, the same reference numerals denote the same elements.

A laundry treatment apparatus according to an embodiment of the present invention may be a washing machine (including a washing machine including a dry system) or a dehydrator. Hereinafter, the laundry treatment apparatus according to embodiment is illustrated as being a washing machine, but is not necessarily limited thereto.

Furthermore, the laundry treatment apparatus an embodiment of the present invention may be a front loading type in which the rotation axis X of a drum has been inclined forward or a top loading type in which the rotation axis of a drum is vertical. Hereinafter, the laundry treatment apparatus according to embodiment is illustrated as being the front loading type washing machine, but is not necessarily limited thereto. For example, in the top loading type washing machine according to another embodiment, a laundry feeding hole and a door are formed on the upper side.

That is, in the front loading type washing machine described in the entire description of the present invention, the front direction and back direction of the drum may be construed as being the upward direction and downward direction of the drum in the top loading type washing machine according to another embodiment. Furthermore, in the entire description of the present invention, in relation to the angle of the rotation axis X of the drum, that is, a basis, the rotation axis of the drum that is vertical may be construed as being a basis in the top loading type washing machine according to another embodiment.

It is evident to those skilled in the art that the characteristics of the front loading type washing machine according to an embodiment are applied to the top loading type washing machine according to another embodiment in such a manner. The front loading type washing machine is described below as a basis, for convenience of a description.

Accordingly, in a description of elements coupled to a drum 20, such as a balancer 110 and an inflow channel device 140, the "back direction" refers to a direction that belongs to both directions of the rotation axis X and that is directed toward the bottom of the drum 20, and the "front direction" refers to a direction that belongs to both direction of the rotation axis X and that is directed toward the opening portion of the drum 21. In the top loading type washing machine, the front direction and the back direction may be construed as being reversed when the direction of the bottom surface of the drum and the direction of the opening portion of the drum are reversed.

In the entire description of the present invention, a "centrifugal direction" refers to a direction that becomes distant from the rotation axis X of the drum 20, and a "direction opposite the centrifugal direction" refers to a direction that becomes close to the rotation axis X of the drum 20. Furthermore, a "circumferential direction" refers to a clockwise and anticlockwise direction around the rotation axis X. Furthermore, in the entire description of the present invention, the "start end" and "termination" of a channel or passage refer to the "end of an upper stream" and the "end of a lower stream" based on the normal fluid flow direction of a corresponding passage.

FIG. 1 is a conceptual diagram showing a lateral section of a washing machine which has been vertically cut in the front and rear direction according to an embodiment of the present invention.

Referring to FIG. 1, the washing machine according to an embodiment of the present invention includes a cabinet 1 forming an external appearance and to have a laundry feeding hole 7 formed at the front thereof, a tub 10 provided within the cabinet 1 for storing washing water, and a drum 20 rotatably installed around the rotation axis X forward inclined within the tub 10 for storing laundry. The washing machine includes a driving unit 30 to rotate the drum 20 and a balancer 110 provided in the drum and to have water selectively introduced into an internal space 110*s* thereof so that eccentricity generated in the drum is reduced.

The cabinet 1 includes a front cover (not shown) forming the front surface of the washing machine and to have the laundry feeding hole 7 formed therein, a top cover (not shown) forming the top of the washing machine, two side covers (not shown) forming both sides of the washing machine, a back cover (not shown) forming the back of the washing machine, and a base (not shown) forming the bottom of the washing machine. The cabinet 1 includes a door 3 that opens and shuts the feeding entrance 7.

The cabinet 1 may be equipped with a control panel (not shown). The control panel may include an input unit, such as keys, buttons, and a touch panel capable of setting, selecting, and adjusting various types of operation mode, a lamp for indicating various pieces of information, such as a response, alarm, and notification according to the operation state and selected operation mode of the washing machine, and a display, such as an LCD panel or an LED panel.

The tub 10 has the inside of an empty cylindrical shape, and a tub opening portion 11 communicating with the laundry feeding hole 7 is formed in the tub 10. A gasket 13 made of an elastic material is provided between the tub opening portion 11 and the laundry feeding hole 7. The gasket 13 prevents washing water within the tub 10 from draining out to the outside of the tub 10 and reduces the transfer of the vibration of the tub 10 to the cabinet.

The drum 20 has the inside of an empty cylindrical shape. The opening portion of the drum 20 communicating with the laundry feeding hole 7 and the tub opening portion 11 are provided at the front of the drum 20. A user may supply laundry to the inside of the drum 20 or draw laundry from the inside of the drum through the laundry feeding hole 7.

A plurality of through holes through which the inside of the drum communicates with the inside of the tub 10 is provided in the circumferential surface of the drum 20. FIG. 1 shows one through hole 27 of the plurality of through holes. Washing water between the tub 10 and the drum 20 can move into the drum 20 through the plurality of through holes 27, and washing water stored in the drum 20 can move into the space between the tub 10 and the drum 20.

Furthermore, the washing machine may further include a vibration-proof unit (not shown) in order to prevent vibration, generated when the drum 20 is rotated, from being delivered to the cabinet 10 through the tub 10. The vibration-proof unit may be formed of an elastic member or a damper. The vibration-proof unit may include a first vibration-proof unit 13 provided at the top of the tub 10 and a second vibration-proof unit 14 provided at the bottom of the tub 10, but is not limited thereto. The vibration-proof unit may be provided at a different location, if necessary.

The driving unit 30 may have various forms capable of rotating the drum 20 within the tub 10. FIG. 1 shows an example of a brushless DC (BLDC) motor which is provided at the back of the tub 10 and rotates the drum 20 through a motor shaft 36 that penetrates the rear surface of the tub.

Referring to FIG. 1, the driving unit 30 may include a stator 35 fixed to the rear surface of the tub 10, the motor shaft 36 penetrating the rear surface of the tub 10 in the rotation axis X and fixed to the rear surface of the drum 20, a rotor 31 surrounding the stator 35 in the circumferential direction of the rotation axis X and to have the motor shaft 36 fixed thereto, and a plurality of permanent magnets 33 fixed to the rotor 31. And, the plurality of permanent magnets 33 rotate the rotor 31 by a magnetic field generated by the stator 35.

The plurality of permanent magnets 33 is fixed to the inner circumferential surface of the rotor 31 at specific intervals. The stator 35 is insulated by an insulator 37 provided to surround the stator 35. The insulator 37 may be equipped with a sensing unit 38 (e.g., a hall sensor) for detecting the rotation speed, rotation direction, and rotation angle of the rotor 31 by detecting a magnetic force of the permanent magnet 33.

The washing machine may include a driving unit support 39 (FIG. 9) for supporting the driving unit 30. In the present embodiment, the driving unit support 39 has a structure in which a portion for fixing the driving unit 30 is formed at the center thereof and two support members having a downwardly slant angle based on the driving unit are extended to both sides, but is not limited thereto. The driving unit support 39 may have various shapes capable of supporting the driving unit.

The washing machine may further include a power transfer unit 170 fixed to the back side (drum backside portion 28) of the drum 20 to deliver a turning force, generated from the driving unit 30, to the drum 20. In this case, the motor shaft 36 delivers a turning force, generated from the driving unit 30, to the power transfer unit 170. The power transfer unit 170 includes a central portion 171 having the motor shaft 36 mounted thereon and fixed thereto and a plurality of extension portions 173 each extended in the centrifugal direction from the central portion 171.

The washing machine further includes a water supply unit 40 for supplying water from an external water supply source (not shown) to the inside of the tub 10 and a detergent supply unit (not shown) for supplying a detergent to the tub 10. The water supply unit 40 includes a water supply passage 43 for guiding water from the water supply source (not shown) outside the cabinet 1 to the inside of the tub 10 via the detergent supply unit and a water supply valve 41 for opening and shutting the water supply passage 43.

The washing machine further includes a drain pump 55 for pumping water discharged from the tub 10 so that the water flows out to the outside of the cabinet 1. The washing machine may further include a circulation pump (not shown) for pumping water discharged from the tub 10 so that the water is supplied to the inside of the tub 10 again. The drain pump 55 and the circulation pump may be separately provided, or the single pump 55 may be provided to selectively perform drainage and circulation.

The washing machine may further include a drain bellows 53 for guiding water, discharged from the tub 10, to the drain pump 55 and a drain valve (not shown) for controlling the drain bellows 53.

The washing machine includes a drain passage 57 for draining water, pumped by the drain pump 55, to the outside of the cabinet 1, and may include a circulation passage (not shown) for guiding water pumped by the circulation pump so that the water is supplied to the inside of the tub 10 again.

Figure 2:
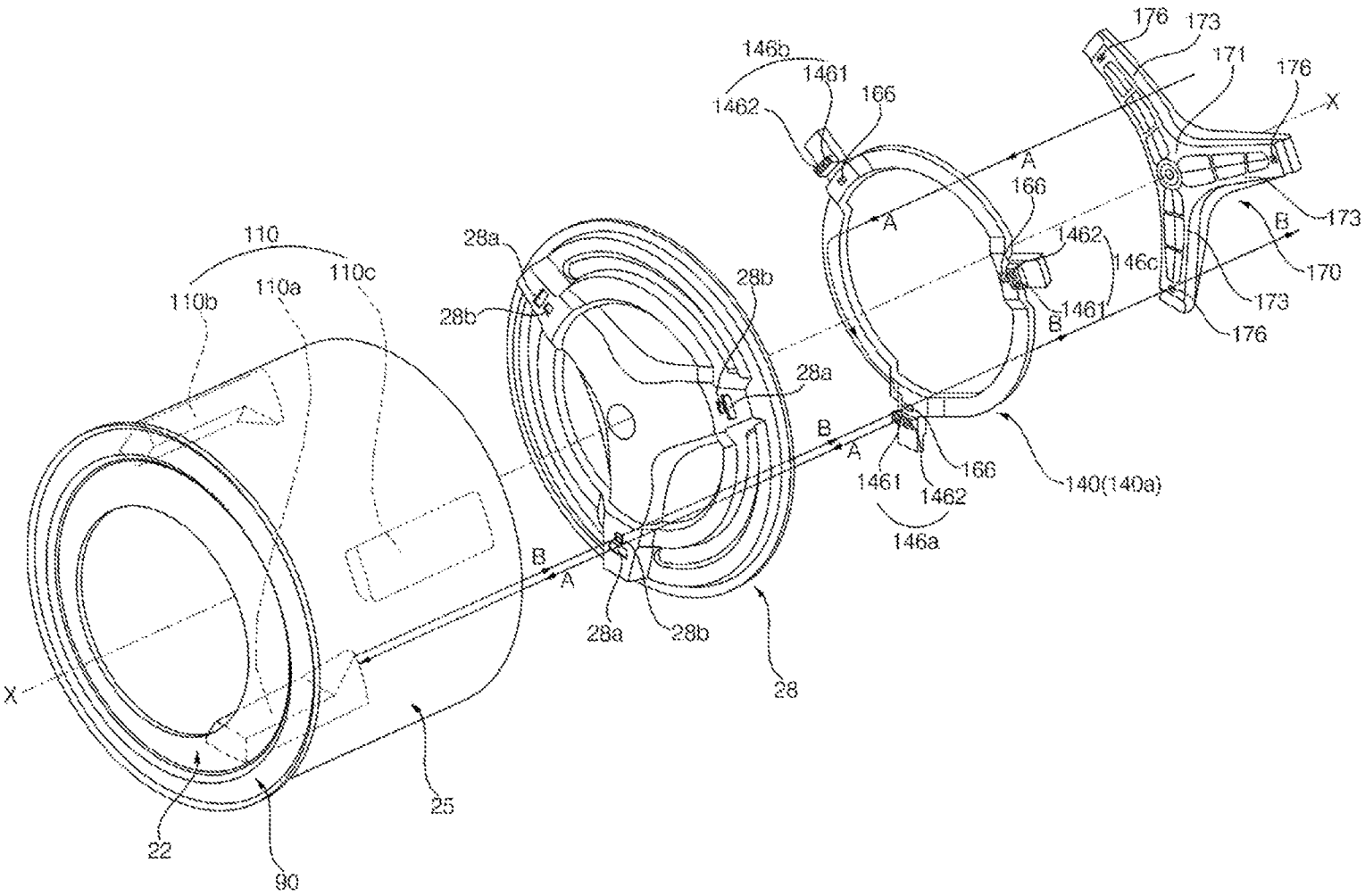
FIG. 2 is a dismantled perspective view showing the drum 20, centrifugal channel device 140*a* that is an embodiment of an inflow channel device 140, power transfer unit 170, etc. of the washing machine according to an embodiment of the present invention.

FIG. 2 is a dismantled perspective view showing the drum 20, centrifugal channel device 140*a* that is an embodiment of the inflow channel device 140, power transfer unit 170, etc. of the washing machine according to an embodiment of the present invention.

Referring to FIG. 2, the drum 20 includes a drum front end portion 22 having the opening portion of the drum 21 formed therein, a drum body 25 forming a circumferential surface in the circumference of the rotation axis X of the drum 20, and a drum backside portion 28 forming the backside of the drum 20.

The drum front end portion 22 is extended in the circumferential direction thereof and formed in a ring shape, and may be equipped with a ball balancer 90 or fluid balancer 90 in which a ball or a fluid is accommodated.

The balancer 110 may be provided in the circumferential surface of the drum body 25. The plurality of through holes 27 is formed in the circumferential surface of the drum body 25.

A space in which water is accommodated is formed in the balancer 110. Water selectively flows into the internal space 110*s* of the balancer 110 so that eccentricity generated in the drum 20 is reduced. The balancer 110 is provided in the drum 20 and disposed to come into contact with the inner rear surface of the drum 20. A plurality of the balancers 110 may be disposed on the circumference of the drum 20 in such a way as to be spaced apart from each other.

The washing machine includes the inflow channel device 140 for guiding water so that it selectively flows from the back of the drum 20 to the internal space 110*s* of the balancer 110 in order to reduce eccentricity generated in the drum 20. The inflow channel device 140 guides water so that it selectively flows from the back of the drum 20 to the internal space of the plurality of balancers 110 when the drum 20 is rotated. The inflow channel device 140 guides water so that it selectively flows into the internal space of the plurality of balancers 110 by a centrifugal force generated when the drum 20 is rotated. The outflow channel 190 to be described later guides water so that the water selectively flows out from the internal space of the plurality of balancers 110 to the outside of the drum 20 when the drum 20 is rotated.

The inflow channel device 140 may have various shapes. The eccentricity of the drum 20 is problematic only when the drum 20 is rotated, and thus the inflow channel device 140 needs to perform its own function when the drum 20 is rotated. However, the inflow channel device 140 may have a structure using a centrifugal force generated when the drum 20 is rotated because the inflow channel device 140 is coupled to the drum backside portion 28 and rotated along with the drum 20. In the present embodiment, the centrifugal channel device 140*a* is proposed as an embodiment of the inflow channel device 140.

Furthermore, the extension portions 173 of the power transfer unit 170 are extended in the centrifugal direction directed toward the locations of the plurality of balancers 110, respectively. In the present embodiment, three balancers 110*a*, 110*b*, and 110*c* are provided. Three extension portions 173*a*, 173*b*, and 173*c* extended in directions corresponding to the respective three balancers 110*a*, 110*b*, and 110*c* are provided. If n (a natural number) balancers larger than the three balancers are provided, n extension portions extended in directions corresponding to the respective balancers may be provided.

The inflow channel device 140 and the power transfer unit 170 may be overlaid on the back side of the drum backside portion 28. The centrifugal channel device 140*a* has a portion forward rounded compared to other portions so that it is engaged with the power transfer unit 170. A region that belongs to the drum backside portion 28 and that corresponds to the centrifugal channel device 140*a* and the power transfer unit 170 at the backside of the drum backside portion 28 is forward rounded so that the drum backside portion 28 is engaged with the centrifugal channel device 140*a* and the power transfer unit 170.

Embodiments of the balancer 110 and inflow channel device 140 of FIG. 2 are described in detail below.

Figure 3:
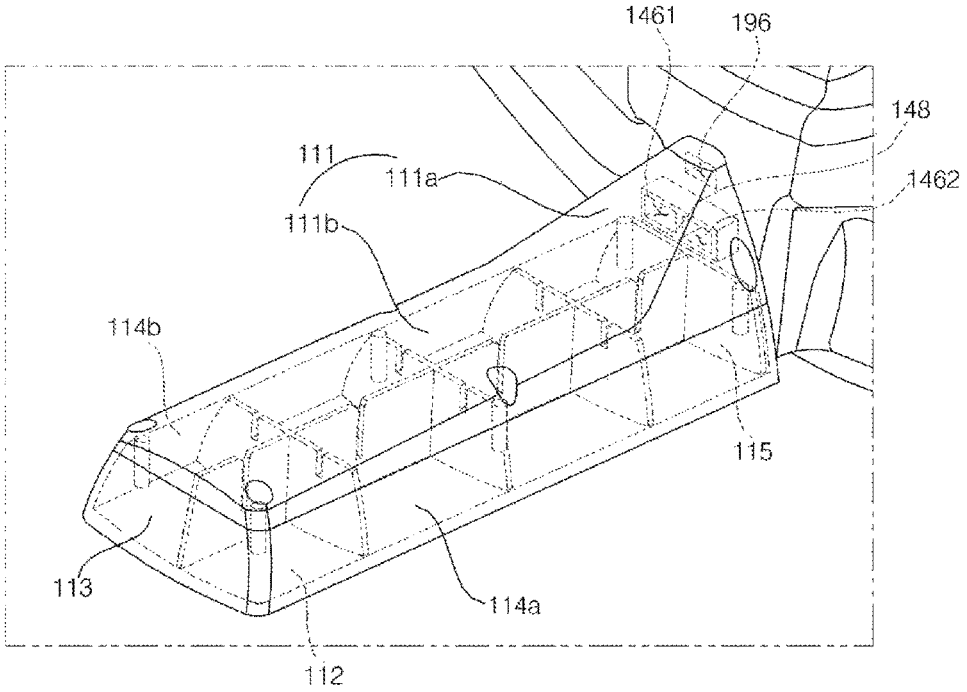
FIG. 3 is a perspective view showing the state in which one of balancers 110 of FIG. 2 has been assembled.
Figure 4:
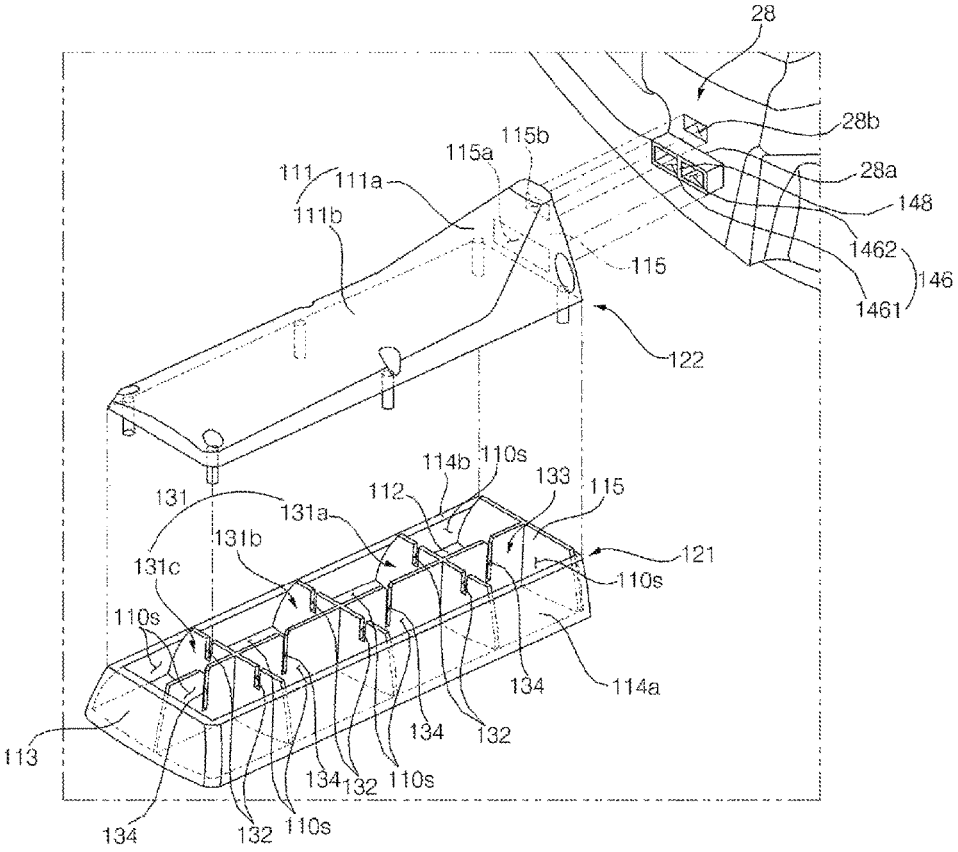
FIG. 4 is a perspective view showing the state in which one of the balancers 110 of FIG. 2 has been dismantled.
Figure 5:
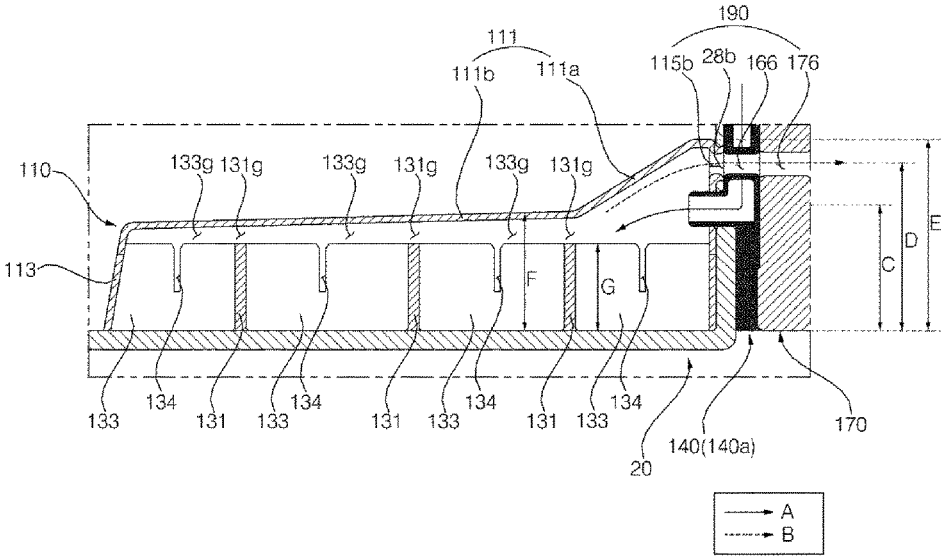
FIG. 5 is a side cross-sectional view of the balancer 110 of FIG. 3 which has been vertically cut in the front and rear direction.

FIG. 3 is a perspective view showing the state in which one of the balancers 110 of FIG. 2 has been assembled. FIG. 4 is a perspective view showing the state in which one of the balancers 110 of FIG. 2 has been dismantled. FIG. 5 is a side cross-sectional view of the balancer 110 of FIG. 3 which has been vertically cut in the front and rear direction.

The balancer 110 is means for reducing the eccentricity of the drum by increasing weight of a region symmetrical to the region in which laundry causing the eccentricity is located around the rotation center of the drum 20.

The balancers 110 may be provided to be spaced apart from the front end of the drum 20 or may be provided to be spaced apart from the rear end of the drum 20. In the present embodiment, an example in which the balancers 110 are provided to be spaced apart from the front end of the drum 20 is described. In this case, the ball balancer 90 or the fluid balancer 90 is provided in the drum front end portion 22, thereby being capable of reducing the eccentricity of the drum 20. The balancers 110 are provided in a region from the middle region of the drum 20 to the rear end portion of the drum 20, thereby being capable of reducing eccentricity. Accordingly, the ball balancer or fluid balancer 90 and the balancers 110 can reduce the eccentricity of the drum 20 through mutual cooperation.

The balancers 110 may be fixed to the outer circumferential surface of the drum 20 or may be provided to penetrate the outer circumferential surface and inner circumferential surface of the drum 20. In the present embodiment, the balancers 110 may be protruded from the inner circumferential surface of the drum 20 in the direction opposite the centrifugal direction. If the balancers 110 are protruded from the inner circumferential surface of the drum 20, the balancers 110 according to an embodiment of the present invention can function as means for reducing eccentricity and can also function as means for agitating laundry stored in the drum when the drum is rotated.

Referring to FIGS. 3 and 4, each of the balancers 110 includes a balancer front cover 113 having a side end in the centrifugal direction coupled to the inner circumferential surface of the drum body 25 in such a way as to form the front surface of the balancer 110, two balancer side covers 114*a* and 114*b* having their front ends coupled to the balancer front cover 113 in such a way as to form both sides of the balancer 110 in the circumferential direction and to have the side ends thereof in the centrifugal direction coupled to the inner circumferential surface of the drum body 25, and a balancer top cover 111 having its front end coupled to the balancer front cover 113 in such a way as to form a surface that faces the direction opposite the centrifugal direction of the balancer 110 and to have both side ends thereof in the circumferential direction coupled to the balancer side covers 114*a* and 114*b*, respectively.

The balancer 110 may further include a balancer base cover 112 having its front end coupled to the balancer front cover 113 in such a way as to form a surface that faces the centrifugal direction and to have both side ends thereof in the circumferential direction coupled to the balancer side covers 114*a* and 114*b*, respectively. In this case, the balancer base cover 112 may be configured in such a manner that the front end of a separate plate member comes into contact with the inner circumferential surface of the drum body 25 or some region itself of the inner circumferential surface of the drum body 25 may function as the balancer base cover 112. The present embodiment corresponds to the latter case, but is not limited thereto.

The balancer 110 may further include a balancer back cover 115 having a top end thereof coupled to the balancer top cover 111 in such a way as to form a back side and to have both side ends thereof in the circumferential direction coupled to the balancer side covers 114*a* and 114*b*, respectively. In this case, the balancer back cover 115 may be configured in such a manner that the front surface of a separate plate member comes into contact with the front surface of the drum backside portion 28 or some region itself of the front surface of the drum backside portion 28 may function as the balancer back cover 115. The present embodiment corresponds to the former case, but is not limited thereto.

The space surrounded by the balancer front cover 113, the two balancer side covers 114*a* and 114*b*, the balancer top cover 111, the balancer base cover 112, and the balancer back cover 112 is defined as the internal space 110*s* of the balancer 110. As the internal space 110*s* of the balancer is filled with water or becomes empty, eccentricity can be reduced when the drum 20 is rotated.

Referring to FIG. 4, the balancer 110 may be configured in such a manner that a balancer body portion 121 to form an external appearance on the centrifugal direction side and a balancer cap portion 122 to form an external appearance on the direction side opposite the centrifugal force are coupled. The balancer body portion 121 and the balancer cap portion 122 may be coupled by screws, bolts, nuts and/or hooks. The balancer body portion 121 is a member that forms the bottom of the balancer front cover 113, the bottom of the two balancer side covers 114*a* and 114*b*, and the bottom of the balancer back cover 112. The balancer cap portion 122 is a member that forms the top of the balancer front cover 113, the top of the two balancer side covers 114*a* and 114*b*, the top of the balancer back cover 112, and the balancer top cover 111.

The balancer 110 may be lengthily formed in the front and rear direction of the drum 20. In this case, the internal space 110*s* of the balancer is also lengthily formed in the front and rear direction.

The balancer 110 may further include an inclined portion 111*a* in which the protrusion height of a rear end portion thereof (i.e., a protrusion height measured on the inner circumferential surface of the drum) is greater than the protrusion height of other portions. The rear end of the balancer top cover 111 has a slope in the direction opposite the centrifugal direction and has an increasing protrusion height, thus forming the inclined portion 111*a*. In this case, the section in which the inclined portion 111*a* has been formed may be a length corresponding to ⅕ to ⅓ of the entire length in the front and rear direction of the balancer 110. A rear end that belongs to the inclined portion 111*a* and has the highest protrusion height is coupled to the front surface of the drum backside portion 28.

A plurality of the balancers 110 may be provided. The plurality of balancers 110 may be spaced apart from each other in the circumferential surface of the drum 20. The plurality of balancers 110 may be spaced apart from each other at specific intervals. That is, the plurality of balancers may be spaced apart from each other at intervals of the same angle around the rotation axis X.

At least three balancers may be spaced apart from each other at intervals of a specific angle around the rotation axis X. If three balancers 110*a*, 110*b*, and 110*c* are provided as in the present embodiment, the balancers 110 are disposed at intervals of 120 degrees around the rotation axis X. If n (n is a natural number of 4 or greater) balancers 110 greater than the three balancers are provided, the balancers 110 are disposed at intervals of 360/n degrees around the rotation axis X. In order for a reduction of eccentricity to be easily controlled, 3 or more balancers 110 may be equally disposed on the circumference of the drum 20.

The balancer 110 may include a partition for partitioning the internal space 110*s* of the balancer. A plurality of the partitions may be provided. The partitions are classified into a lateral partition 131 for dividing the front and rear of the internal space 110*s* of the balancer and a vertical partition 133 for dividing the internal space 110*s* of the balancer in the circumferential direction.

The lateral partition 131 is a member of a rib form, which is protruded from the balancer base cover 112 in the direction opposite the centrifugal direction and extended in the circumferential direction. The lateral partition 131 divides the internal space 110*s* of the balancer in the front and rear direction, but includes a termination spaced apart from the inside surface of the internal space 110*s* of the balancer in the direction opposite the centrifugal direction (i.e., a surface that faces the centrifugal direction of the balancer top cover 111). The internal spaces 110*s* of the balancer that have been divided front and rear communicate with each other through a gap 131*g* between the termination of the lateral partition 131 and the inside surface of the internal space 110*s*.

Lateral partition grooves 132 formed at the termination of the lateral partition 131 in the centrifugal direction may be formed in the lateral partition 131 so that the spaces divided by the lateral partition 131 communicate with each other. The lateral partition grooves 132 may be formed to be symmetrical to the lateral partition 131 left and right.

A plurality of the lateral partitions 131 may be provided. The plurality of lateral partitions 131 may be spaced apart from each other in the front and rear direction. The plurality of lateral partitions may be spaced apart from each other at specific intervals. In the present embodiment, three lateral partitions 131*a*, 131*b*, and 131*c* divide the internal space 110*s* of the balancer into a first space, a second space, a third space, and a fourth space from the back side. In an embodiment in which n (n is a natural number) lateral partitions greater than the three lateral partitions are provided, the internal space 110*s* of the balancer is divided into a first space to a (n+1)-th space from the back side. Accordingly, water introduced into the back side of the internal space 110*s* of the balancer can be sequentially filled from the first space to the (n+1)-th space. In this case, the introduced water flows into the space on the front side through the lateral partition grooves 132. Accordingly, the role of the lateral partition 131 is not to prevent water from flowing into the side on the front side until the space on the back side is fully filled with the water, but is to reduce the speed at which the space on the front side is filled with water compared to the speed at which the space on the back side is filled with water.

The vertical partition 133 is a member of a rib form, which is protruded from the balancer base cover 112 in the direction opposite the centrifugal direction and extended in the front and rear direction. The vertical partition 133 divides the internal space 110*s* of the balancer in the circumferential direction, and includes a termination spaced apart from the inside surface of the internal space 110*s* of the balancer (i.e., a surface that faces the centrifugal direction of the balancer top cover 111) in the direction opposite the centrifugal direction. The internal spaces 110*s* of the balancer that are divided in the circumferential direction communicate with each other through a gap 133*g* between the termination of the vertical partition 133 and the inside surface of the internal space 110*s*.

The vertical partition 133 may form a vertical partition groove 134 formed at the termination of the vertical partition 133 the centrifugal direction so that the spaces divided by the vertical partition 133 communicate with each other. A plurality of the vertical partition grooves 134 may be formed in the vertical partition 133. The same number of lateral partition grooves 134 may be formed in each of the sections of the vertical partition 133 that cross the spaces divided by the lateral partitions 131. In the present embodiment, the vertical partition grooves 134 are formed in the first space to the (n+1)-th space, respectively.

One vertical partition 133 may be provided so that it divides the central portion of the internal space 110*s* of the balancer 110. In this case, assuming that a virtual plane on which the vertical partition 133 is disposed is present, a channel partition 148 to be described later divides an inflow hole 146, disposed on the virtual plane and formed a channel termination within the inflow channel device 140, into two.

A first inflow opening portion 115*a*, that is, a point at which water flows into the internal space 110*s* of the balancer 110, may be formed in the balancer back cover 115. The inflow channel device 140, 140*a* may include a front channel 145 extended in the direction of the inflow hole 146 from the back of the balancer back cover 115. In this case, the front channel 145 is disposed to penetrate the first inflow opening portion 115*a*. In this case, a second inflow opening portion 28*a* through which the front channel 145 penetrates is formed in the drum backside portion 28. Water introduced into the internal space 110*s* of the balancer through the front channel 145 sequentially passes through the second inflow opening portion 28*a* and the first inflow opening portion 115*a*.

Water may flow backward through the inflow hole 146, and thus water within the internal space of the balancer 110 may flow out. As in the present embodiment, the washing machine may include a separate outflow channel 190 for guiding water so that the water flows out from the inside of the balancer 110. The outflow channel 190 may be formed in the back direction of the balancer 110. An opening portion formed at the start end of the outflow channel 190 is defined as an outflow hole 196.

A first outflow opening portion 115*b*, that is, a point at which water flows out from the internal space 110*s* of the balancer 110, may be formed in the balancer back cover 115. Furthermore, the outflow channel 190 may be disposed to start from the front of the balancer back cover 115 and to penetrate the first outflow opening portion 115*b*. The start end of the outflow channel 190 coincides with the first outflow opening portion 115*b*, and thus the first outflow opening portion 115*b* itself may have the same concept as the outflow hole 196.

The outflow channel 190 may be provided to penetrate the balancer back cover 115 and the back side of the drum 20 (e.g., the drum backside portion 28, the centrifugal channel device 140*a*, and the power transfer unit 170) so that the internal space 110*s* of the balancer and the outside of the drum 20 communicate with each other. A second outflow opening portion 28*b* through which the outflow channel 190 penetrates is formed in the drum backside portion 28. A third outflow opening portion 166 through which the outflow channel 190 penetrates is formed in the centrifugal channel device 140*a*. A fourth outflow opening portion 176 through which the outflow channel 190 penetrates is formed in the power transfer unit 170. Water that flows out from the internal space 110*s* of the balancer through the outflow channel 190 sequentially passes through the first outflow opening portion 115*b*, the second outflow opening portion 28*b*, the third outflow opening portion 166, and the fourth outflow opening portion 176.

Referring to FIG. 5, the outflow hole 196 is disposed in the direction opposite the centrifugal direction with respect to the inflow hole 146 formed at the point at which water flows from the inflow channel device 140 to the internal space of the balancer 110. That is, a height D from the inner circumferential surface of the drum 20 to the outflow hole 196 is greater than a height C from the inner circumferential surface of the drum 20 to the inflow hole 146.

In this case, the balancer 110 protruded from the inner circumferential surface of the drum 20 is provided so that the protrusion height E of the rear end of the balancer is greater than the height D from the inner circumferential surface of the drum 20 to the outflow hole 196 and the protrusion height F of the front portion 111*b* of the inclined portion 111*a* is smaller than the height D from the inner circumferential surface of the drum 20 to the outflow hole 196.

Furthermore, the protrusion height G of the lateral partition 131 may be smaller than the height C from the inner circumferential surface of the drum 20 to the inflow hole 146, and the protrusion height G of the vertical partition 133 may be smaller than the height C from the inner circumferential surface of the drum 20 to the inflow hole 146. The protrusion height G of the lateral partition 131 and the protrusion height G of the vertical partition 133 may be the same.

Figure 6:
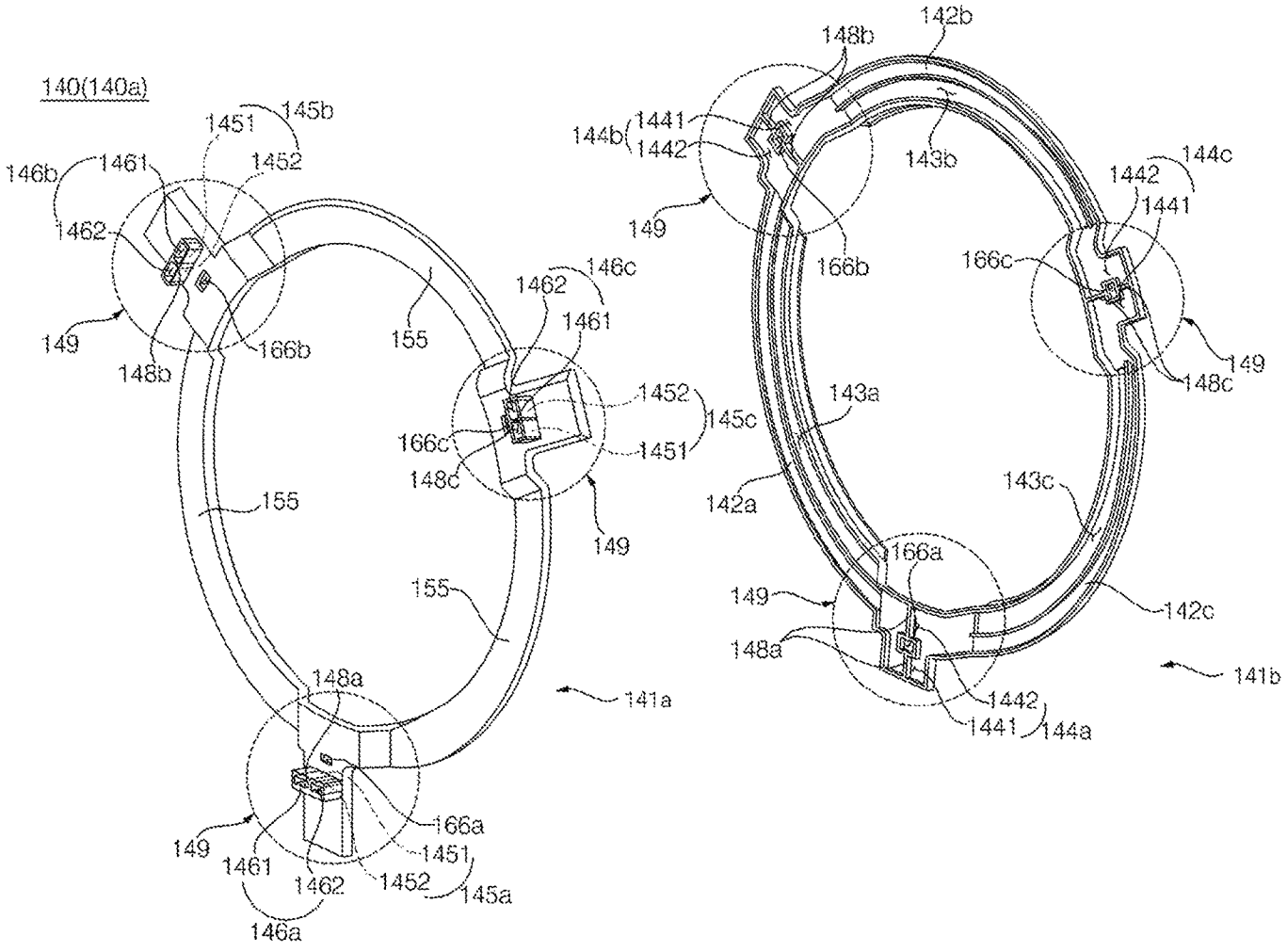
FIG. 6 is a dismantled perspective view showing the state in which the centrifugal channel device 140*a*, that is, an embodiment of the inflow channel device 140, has been dismantled into a front portion 141*a* and a rear portion 141*b*.
Figure 7:
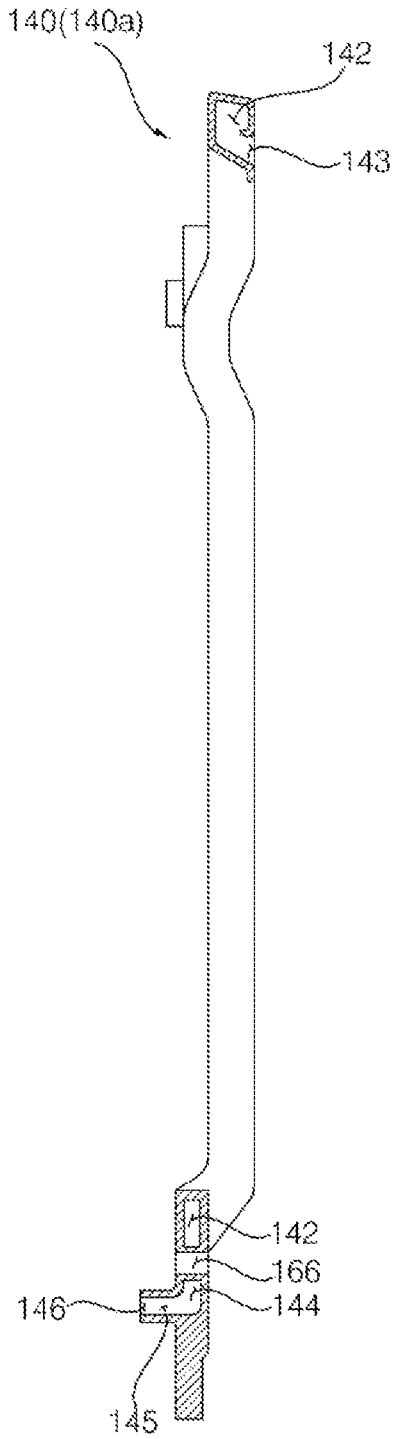
FIG. 7 is a side cross-sectional view of the centrifugal channel device 140*a* of FIG. 6, which has been vertically cut in the front and rear direction.
Figure 8:
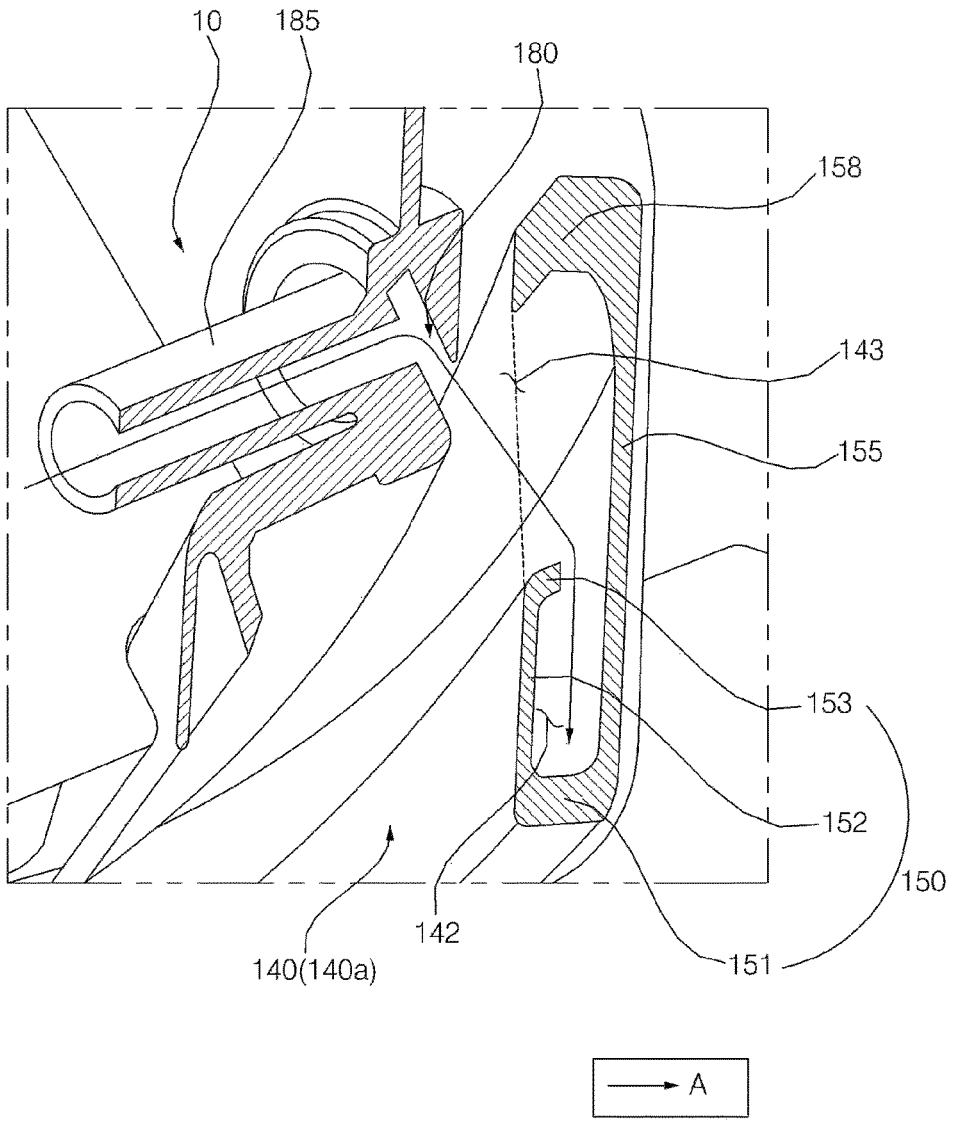
FIG. 8 is an enlarged sectional view showing the state in which part of the circumferential channel 142 of the centrifugal channel device 140*a* of FIG. 6 has been vertically cut in the front and rear direction and shown along with a nozzle 180.
Figure 9:
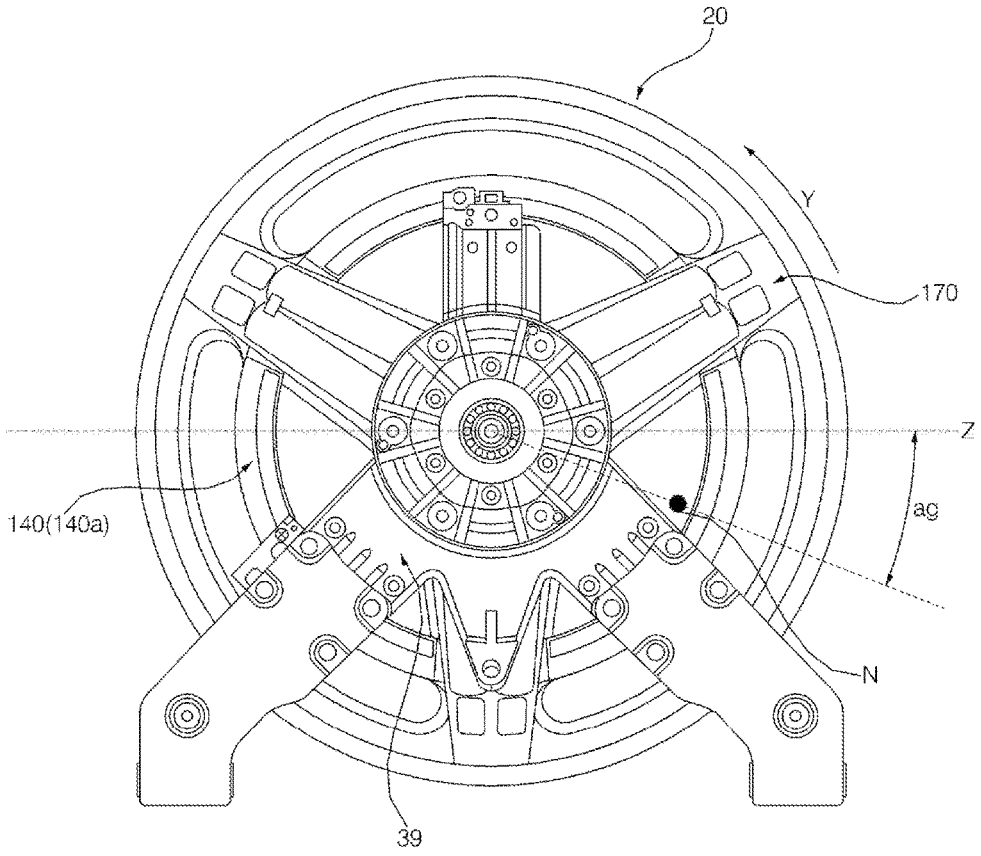
FIG. 9 is an elevation showing a driving unit support 39 when looking at a drum 20 at the back of the drum 20.
Figure 10:
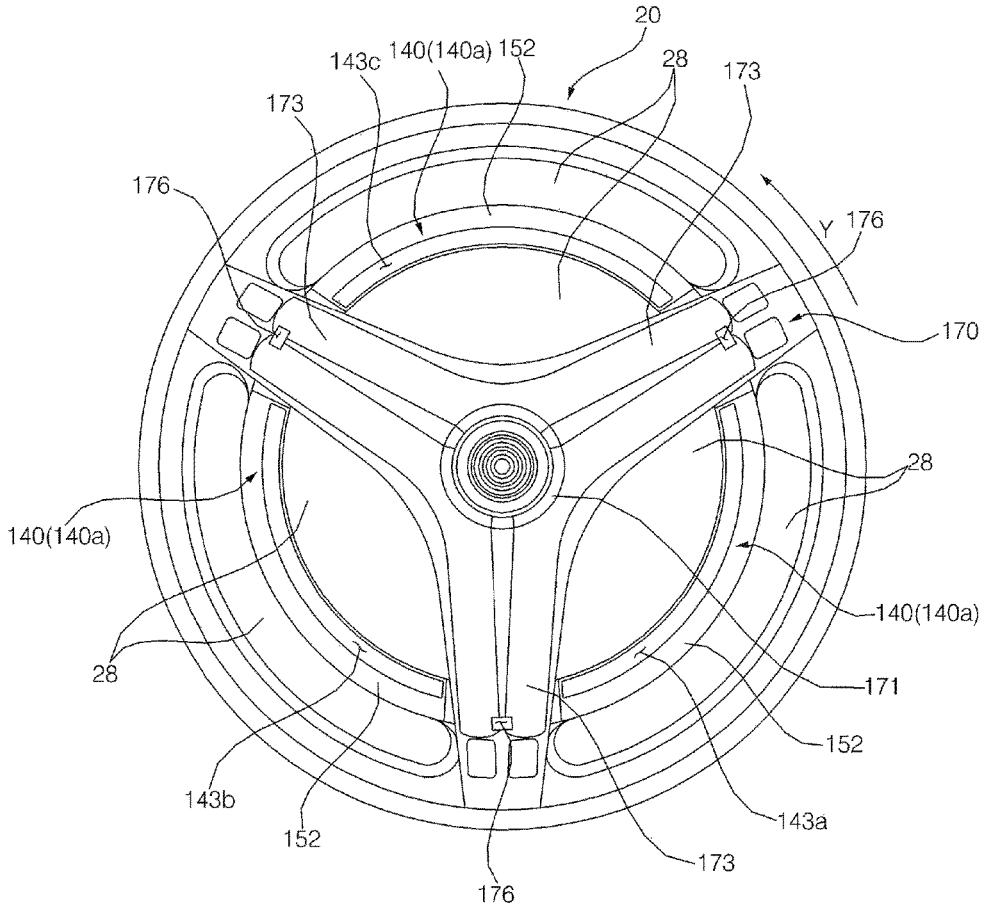
FIG. 10 is an elevation showing the state in which the driving unit support 39 has been omitted while looking at the drum 20 at the back of the drum 20.

FIG. 6 is a dismantled perspective view showing the state in which the centrifugal channel device 140*a*, that is, an embodiment of the inflow channel device 140, has been dismantled into a front portion 141*a* and a rear portion 141*b*. FIG. 7 is a side cross-sectional view of the centrifugal channel device 140*a* of FIG. 6, which has been vertically cut in the front and rear direction. FIG. 8 is an enlarged sectional view showing the state in which part of the circumferential channel 142 of the centrifugal channel device 140*a* of FIG. 6 has been vertically cut in the front and rear direction and shown along with a nozzle 180. FIG. 9 is an elevation showing the driving unit support 39 when looking at the drum 20 at the back of the drum 20. FIG. 10 is an elevation showing the state in which the driving unit support 39 has been omitted while looking at the drum 20 at the back of the drum 20.

Referring to FIGS. 6 to 10, the centrifugal channel device 140*a*, that is, an embodiment of the inflow channel device 140, is disposed on the back side of the drum 20 and rotated along with the drum 20. An opening portion 143 is formed in the centrifugal channel device 140*a* in the back direction so that water is supplied to the opening portion 143. The centrifugal channel device 140*a* guides water, supplied through the opening portion 143, to the internal space 110*s* of the balancer 110. Furthermore, the washing machine includes the nozzle 180 disposed at the back of the drum and spaced apart from the drum. The nozzle 180 sprays water toward the opening portion 143.

The centrifugal channel device 140*a* is extended in the circumferential direction of the drum 20. The centrifugal channel device 140*a* may have a generally disc shape or may be a ring shape as in the present embodiment.

The opening portion 143 is formed in the circumferential direction of the drum 20. A plurality of the opening portions 143 greater than the number of balancers 110 may be formed in the circumferential direction of the drum 20 and spaced apart from each other. As in the present embodiment, however, the number of opening portions 143 corresponding to the number of balancers 110 may be lengthily formed in the circumference direction of the drum. The opening portions 143 are lengthily formed on a concentric circle around the rotation axis X. Water consecutively sprayed by the nozzle 180 continues to reach the location at a specific distance from the rotation axis X. If the opening portions 143 are lengthily formed on the concentric circle, sprayed water continues to flow into the inside of the centrifugal channel device 140*a* although the drum 20 is rotated.

A plurality of the opening portions 143 corresponding to the number of balancers 110 may be formed so that they correspond to the respective balancers 110. An example in which each of the opening portions 143 corresponds to each of the balancers 110 is described below. It means that any one opening portion 143*a* is lengthily formed in the back side of the centrifugal channel device 140*a*, corresponding to any one balancer 110*a* and an adjacent balancer 110*b*, in the circumferential direction in the form of an arc that connects two balancers 110*a* and 110*b*. In the present embodiment, three opening portions 143*a*, 143*b*, and 143*c* capable of being supplied with guided water are provided in respective three balancers 110*a*, 110*b*, and 110*c*. If n (n is a natural number) balancers 110 greater than the three balancers are provided, n opening portions 143 may be provided.

The centrifugal channel device 140*a* includes sandwich units 149 disposed between the plurality of extension portions 173 and the back side of the drum 20. In the centrifugal channel device 140*a*, the sandwich units 149 are formed in the section in which the plurality of opening portions 143 has been spaced apart from each other. The back side of the sandwich unit 149 comes into contact with the front surface of the extension portion 173, and the front surface of the sandwich unit 149 comes into contact with the back side of the drum 20. The centrifugal channel device 140*a* is formed so that the rear surfaces of the plurality of sandwich units 149 are rounded toward the front and engaged with the plurality of extension portions 173. Furthermore, the back side of the drum backside portion 28 is rounded toward the front so that the front surface of the sandwich unit is engaged with a shape protruded toward the front. Such engaged shapes help a load, applied to the balancer 110, to be more delivered to the extension portion 173 of the power transfer unit 170, thereby improving the stability of the entire structure.

The inflow hole 146 is formed in the front surface of the sandwich unit 149. A centrifugal channel 144 to be described later, the front channel 145, and the channel partition 148 are disposed in the sandwich unit 149. Furthermore, the outflow channel 190 is formed to penetrate the back side of the drum 20, the sandwich unit 149, and the extension portion 173 so that the internal space 110*s* of the balancer communicates with the outside of the drum 20. The third outflow opening portion 166 through which the outflow channel 190 penetrates from the front to the back is formed in the sandwich unit 146.

The centrifugal channel device 140*a* forms the circumferential channel 142. The centrifugal channel device 140*a* includes the circumferential channel 142 that forms the space in which supplied water is received in the centrifugal direction by a centrifugal force according to the rotation of the drum 20. The circumferential channel 142 provides a channel through which supplied water moves in the circumferential direction of the drum 20. The direction in which water flows on the circumferential channel 142 may be opposite the direction in which the centrifugal channel device 140*a* is rotated.

The centrifugal channel device 140*a* form the centrifugal channel 144. The circumferential channel 142 is disposed in the direction opposite the centrifugal direction with respect to the inflow hole 146. That is, the distance from the rotation axis X to the location of the inflow hole 146 is greater than the distance from the rotation axis X to the circumferential channel 142 (i.e., the radius of the circumferential channel 142). Furthermore, the centrifugal channel device 140*a* includes the centrifugal channel 144 extended in the centrifugal direction from the circumferential channel 142. Accordingly, water received in the circumferential channel 142 can flow into the centrifugal channel 144 by the centrifugal force. As a result, the water can move into the inflow hole 146. The distance from the rotation axis X to the termination of the centrifugal channel 144 may be smaller than or equal to the distance from the rotation axis X to the location of the inflow hole 146.

The centrifugal channel device 140*a* forms the front channel 145. The centrifugal channel device 140*a* may include the front channel 145 extended from the centrifugal channel 144 to the inflow hole 146. The start end of the front channel 145 is connected to the termination of the centrifugal channel 144.

The centrifugal channel device 140*a* includes the channel partition 148 that divides the circumferential channel 142 into the channels 142*a*, 142*b*, and 142*c* having the same number as the balancers 110. The channel partition 148 induces water, supplied to one channel (i.e., one of the channels 142*a*, 142*b*, and 142*c*), to flow into only a specific balancer (i.e., one of the balancers 110*a*, 110*b*, and 110*c*) when the drum 20 is rotated in a specific direction. The channel partition 148 divides the circumferential channel 142 into a plurality of channels having the same number as the plurality of balancers 110*a*, 110*b*, and 110*c*, and induces water, supplied to one of the plurality of divided channels, to flow into only one of the plurality of balancers 110*a*, 110*b*, and 110*c* when the drum 20 is rotated in a specific direction.

The channel partition 148 may divide the circumferential channel 142 into the plurality of channels 142*a*, 142*b*, and 142*c* at the same angles as angles at which the plurality of balancers 110 is placed around the rotation axis X. The channel partition 148 has a partition structure that has been extended at the angle. The centrifugal channel 144 may be extended in the centrifugal direction in the direction in which the channel partition 148 is extended. In this case, the channel partition 148 divides one centrifugal channel 144 into a first centrifugal channel 1441 and a second centrifugal channel 1442. Furthermore, the channel partition 148 may be additionally extended along the front channel 145. In this case, the channel partition 148 divides one front channel 145 into a first front channel 1451 and a second front channel 1452. In this case, the inflow hole 146 is divided into a first inflow hole 1461 and a second inflow hole 1462 by the channel partition 148 that intersects the center of the inflow hole 146. That is, the channel partition 148 may be extended in the centrifugal direction from the center of the inflow hole 146, and may divide the inflow hole 146, the front channel 145, the centrifugal channel 144, and the circumferential channel 142.

Assuming that a virtual plane on which the channel partition 148 is disposed is present, the vertical partition 133 may be disposed on the virtual plane. Accordingly, water introduced from any one of the first inflow hole 1461 and the second inflow hole 1462 to the internal space 110*s* of the balancer may be induced to flow into the space that belongs to the two internal spaces 110*s* of the balancer divided by the vertical partition 133 at the center and that is placed on the same side as the side of one inflow hole (i.e., one of the inflow holes 1461 and 1462).

In the present embodiment, the three channel partitions 148*a*, 148*b*, and 148*c* are spaced apart from each other at intervals of 120 degrees. And, the three channel partitions 148*a*, 148*b*, and 148*c* guide water into the three balancers 110*a*, 110*b*, and 110*c*, respectively. And thus, the three channel partitions 148*a*, 148*b*, and 148*c* divide the circumferential channel 142 into the three spaces 142*a*, 142*b*, and 142*c*. If n (n is a natural number) balancers 110 greater than the three balancers are provided, n channel partitions 148 may be provided.

A lateral cross-section of the circumferential channel 142 and the opening portion 143 is described in more detail below with reference to FIG. 8.

The centrifugal channel device 140*a* includes an outside wall 150, that is, a rib having curvature, which is extended in the circumferential direction of the centrifugal channel device 140*a* in order to prevent water, introduced through the opening portion 143, from flowing in the centrifugal direction. When the centrifugal channel device 140*a* is rotated, water is subjected to a centrifugal force, but is contained in the circumferential channel 142 without departing in the centrifugal direction because the outside wall 150 applies a centripedal force to the water.

The centrifugal channel device 140*a* further includes a guide wall 155 forming a surface that guides water introduced into the opening portion 143 so that the water flows in the centrifugal direction. The guiding surface of the guide wall 155 may be formed vertically with respect to the rotation axis X, but is not necessarily limited thereto and may be formed at a specific angle. The guide wall 155 is extended in the circumferential direction of the centrifugal channel device 140*a*. Water sprayed by the nozzle 180 flows into the centrifugal channel device 140*a* through the opening portion 143 and collides against the guide wall 155, thereby being guided in the centrifugal direction.

The centrifugal channel device 140*a* may further include an inside wall 158 that is formed in the direction opposite the centrifugal direction with respect to the opening portion 143 and that forms a surface curved from the guide wall 155 in the back direction. One end of the inside wall 158 is joined to the guide wall 155, and the other end of the inside wall 158 is directed toward the back direction. The side of the inside wall 158 in the centrifugal direction can function to prevent water that has collided against the guide wall 155 from scattering in the direction opposite the centrifugal direction due to a reason, such as an impact force, thus helping more water to be guided in the centrifugal direction.

The outside wall 150 may include a first outside wall 151 formed in the centrifugal direction with respect to the opening portion 143. And, a the first outside wall 151 forms a surface curved from the guide wall 155 in the back direction. One end of the first outside wall 151 is joined to the guide wall 155, and the other end of the first outside wall 151 is directed toward the back direction. The side of the first outside wall 151 in the direction opposite the centrifugal direction forms the side of the circumferential channel 142 in the centrifugal direction, and thus applies a centripedal force to water within the circumferential channel 142.

The outside wall 150 may further include a second outside wall 152 that form a surface curved from the first outside wall 151 in the direction opposite the centrifugal direction. One end of the second outside wall 152 is joined to the other end of the first outside wall 151, and the other end of the second outside wall 152 is directed toward the direction opposite the centrifugal direction. The opening portion 143 is formed between the other end of the second outside wall 152 and the other end of the inside wall 158. The front side of the second outside wall 152 forms the side of the circumferential channel 142 in the back direction. Accordingly, more water can be received in the circumferential channel 142 as the height of the front side of the second outside wall 152 is increased.

The outside wall 150 may further include a third outside wall 153 that forms a surface curved from the second outside wall 152 in the direction of the guide wall 155. In this case, the termination of the third outside wall 153 is provided to be spaced apart from the guide wall 155. One end of the third outside wall 153 is joined to the other end of the second outside wall 152. The other end of the third outside wall 153 becomes the termination, and it is directed toward the guide wall 155, but is spaced apart from the guide wall 155 so that the guide wall 155 forms a gap. The gap becomes the space through which water moves in the centrifugal direction by the guide wall 155. The third outside wall 153 can prevent water, scattered due to an impact force generated when the water moved in the centrifugal direction by the guide wall 155 collides against the first outside wall 151 or the second outside wall 152, from exiting from the circumferential channel 142.

Referring to FIG. 8, the washing machine includes a nozzle passage 185 that guides water sprayed through the nozzle 180 into the nozzle 180. The termination of the nozzle passage 185 is connected to the nozzle 180. The start end of the nozzle passage 185 may be connected to the water supply passage 43 so that water from a water supply source (not shown) provided outside the cabinet 1 is supplied to the nozzle 180 or may be directly connected to the water supply source. In another embodiment, the start end of the nozzle passage 185 may be connected to the circulation passage so that washing water within the tub 2 is supplied to the nozzle 180.

Referring to FIG. 8, the nozzle 180 is disposed in the back side of the tub 10 and provided so that water is sprayed toward the back side of the drum 20. Water sprayed by the nozzle 180 may be set so that the sprayed water flows into the opening portion 143 by adjusting water pressure and spray angle of the sprayed water.

Referring to FIG. 9, the nozzle 180 may be disposed in a portion of the back side of the tub 10 other than a portion occupied by the driving unit support 39. Accordingly, the nozzle 180 and the nozzle passage 185 can be prevented from interfering with the driving unit support 39.

The nozzle 180 may be disposed at a height lower than the height of the center of the back side of the drum 20. During the initial time when water flows into the centrifugal channel device 140*a* after it is sprayed through the nozzle 180, a sufficient centrifugal force is not applied because the water has not been sufficiently accelerated in the rotation direction of the centrifugal channel device 140*a*. If a force component that belongs to the force component of gravity affecting the water during such an initial time and that is applied in the direction opposite the centrifugal direction is great, water is not contained in the circumferential channel 142, and more water may flow out in the direction opposite the centrifugal direction. Accordingly, it may be advantageous to dispose the nozzle 180 on the lower side so that a force component in the centrifugal direction that belongs to the force component of gravity affecting the water during the initial time is great.

Accordingly, the nozzle 180 may be disposed at a location other than the driving unit support 39 and at a location lower than the height of the center on the back side of the drum 20. A portion indicated by N in FIG. 9 denotes the location of the nozzle 180 that has been projected forward. In the present embodiment, the nozzle 180 may be disposed at a location that is distant at an acute angle "ag" in the direction opposite a specific rotation direction Y with respect to a horizontal line Z that intersects the rotation axis X on the back side of the drum 20. The acute angle "ag" may be about 20 degrees.

The nozzle 180 may spray water at an angle "a" oblique in the centrifugal direction while being directed toward the opening portion 143. The oblique angle "a" refers to an angle oblique in the centrifugal direction with respect to the front direction. Accordingly, if a speed component in the centrifugal direction of sprayed water is increased, the water can be guided more easily in the centrifugal direction along the guide wall 155.

A flow of inflow of water into the internal space 110*s* of the balancer is described below as an example.

Referring to FIG. 8, water supplied from the water supply source is guided into the nozzle 180 along the nozzle passage 185. The water guided into the nozzle 180 is sprayed toward the centrifugal channel device 140*a* that is being rotated. The water is supplied to the centrifugal channel device 140*a* through any one opening portion (e.g., 143*a*) that belongs to the three opening portions 143*a*, 143*b*, and 143*c* and that is located at the place at which the sprayed water arrives.

Referring to FIG. 6, if the drum 20 and the centrifugal channel device 140*a* are rotated in a specific rotation direction Y, the supplied water is contained in the corresponding circumferential channel 142*a* by a centrifugal force. The water contained in the circumferential channel 142*a* slides in the direction opposite the specific rotation direction Y relatively to the circumferential channel 142*a*. The moving water collides against a corresponding channel partition 148*a*. The water that has collided against the channel partition 148*a* moves in the centrifugal direction by the centrifugal force through the first centrifugal channel 1441 that belongs to the two channels 1441 and 1442 of the centrifugal channel 144*a* divided by the channel partition 148*a* and that communicates with the circumferential channel 142*a*. The water moved in the centrifugal direction moves forward through the first front channel 1451 that belongs to the two channels 1451 and 1452 of the front channel 145*a* divided by the channel partition 148*a* and that communicates with the first centrifugal channel 1441. The forward moved water flows into a specific balancer 110*a* through the first inflow hole 1481 that belongs to the two inflow holes 1481 and 1482 of the inflow hole 148*a* divided by the channel partition 148*a* and that is the termination of the first front channel 1451.

Referring to FIGS. 3 and 4, the water that has introduced into the balancer 110*a* is first contained in the space that belongs to the two internal spaces 110*s* of the balancer divided by the vertical partition 133 and that is located on the side in the specific rotation direction Y. Furthermore, the water is first contained on the back side of the internal spaces 110*s* of the balancer by the lateral partition 131.

Through such an example, although water is introduced into another opening portion 143 or the rotation direction of the drum 20 is reversed or the number of balancers 110 is changed, a detailed inflow of water can be expected.

A flow of outflow of water in the internal space 110*s* of the balancer is described below as an example. For convenience of a description, the rotation speed of the drum 20 that provides a sufficient centrifugal force to the extent that water continues to adhere to the inner circumferential surface of the drum 20 is defined as "specific rotation speed."

Referring to FIG. 5, if the rotation of the drum 20 is the specific rotation speed or more, when a water level from the inner circumferential surface of the drum 20 of the internal space 110*s* of the balancer becomes the height D of the outflow hole, the water starts to flow out from the internal space 110*s* of the balancer.

If the rotation of the drum 20 is less than the specific rotation speed, the balancer 110 is turned over so that the balancer top cover 111 is directed downward as the drum 20 is rotated, and thus the water may flow out from the internal space 110*s* of the balancer. In this case, the inclined portion 111*a* provides an inclined surface that makes water flow in the direction of the outflow hole 196 due to gravity, and provides the space where the water is collected at the front of the outflow hole 196.

Referring to FIG. 2, the water introduced into the outflow channel 190 through the outflow hole 196 is discharged to the space between the drum 20 and the tub 10 sequentially through the first outflow opening portion 115*b*, the second outflow opening portion 28*b*, the third outflow opening portion 166, and the fourth outflow opening portion 176 along the outflow channel 190.

Referring to FIG. 1, the water discharged to the space between the drum 20 and the tub 10 is mixed with washing water within the tub 10 and used to wash laundry or discharged to the outside of the cabinet 1 via the drain bellows 53 and the drain passage 57.

As may be seen from the examples of the flows of inflow/outflow of water, an embodiment of the present invention proposes a structure capable of introducing a specific amount of water into a specific balancer of the plurality of balancers 110. First, the driving unit 30 measures the rotation speed of a motor and determines a region that has become eccentric on the inner circumferential surface of the drum 20. Thereafter, while the drum 20 is rotated from a specific start angle to a specific end angle, a specific amount of water may be sprayed through the nozzle 180 so that the water is introduced into a specific balancer 110 on the side opposite the side of the region that has become eccentric. Although the balancer 110 is not accurately disposed on the side, that is, the exact opposite side of the region that has become eccentric, the amount of water can be properly distributed and introduced into the two balancers 110 adjacent to each other on the exact opposite side of the region that has become eccentric. Accordingly, the eccentricity can be overcome. An embodiment of the present invention proposes a structure for making advantageous such control for overcoming eccentricity.

First, an embodiment of the present invention has an advantage in that the eccentricity of the drum can be reduced actively and positively although the vibration of the drum is any state.

Second, there is an advantage in that eccentricity can be entirely reduced from the front end to the rear end of the drum because the balancer is lengthily formed and the lateral partition is provided within the balancer.

Third, there is an advantage in that the balancer itself agitates laundry because it is protruded from the inner circumferential surface of the drum.

Fourth, there is an advantage in that eccentricity can be reduced in an induced manner because the balancer is protruded from the inner circumferential surface of the drum and thus leads eccentricity to the side location of the balancer.

Fifth, there is an advantage in that weight of the balancer can be changed through control of an eccentricity reduction by proposing the structure in which water flows into the internal space of the balancer and the structure in which flows out from the internal space of the balancer.

Sixth, there is an advantage in that the drum can be rotated in a light state because water in the internal space of the balancer can be drained and thus the water can be exhausted if not necessary although a maximum capacity of water that may be contained in the balancer is increased.

Seventh, there is an advantage in that water in the internal space of the balancer can be naturally drained using the inclined portion.

Although some embodiments of this specification have been illustrated and described above, this specification is not limited to the aforementioned specific embodiments, and a person having ordinary skill in the art to which this specification pertains may modify the present invention in various ways without departing from the gist of the claims. Such modified embodiments should not be individually interpreted from the technical spirit or prospect of this specification.

What is claimed is:

1. A laundry treatment apparatus, comprising:

a cabinet with a laundry feeding hole formed therein;

a tub provided within the cabinet for holding washing water;

a drum installed within the tub for holding laundry;

a driving unit to rotate the drum;

a plurality of balancers each having an internal space formed in the balancer in which water is received , the plurality of balancers spaced apart from each other on a circumference of the drum;

an inflow channel device to selectively guide water from an outside of the drum to the internal spaces of the plurality of balancers when the drum is rotated through an inlet hole formed rear of each balancer; and an outflow channel forming in a back direction of each balancer to guide water so that the water flows out from the internal space of each balancer, wherein at least one of the plurality of balancers includes a partition for partitioning the internal space of the balancer, and wherein a height from the inner circumferential surface of the drum to an outflow hole formed at a start end of the outflow channel and a height from the inner circumferential surface of the drum to the inflow hole are greater than a protrusion height of the partition.

2. The laundry treatment apparatus of claim 1, wherein:

the laundry feeding hole is formed at a front of the cabinet, the drum is rotatably installed around the rotation axis which is inclined forward, the plurality of balancers are provided to come into contact with an inside back of the drum, and the inflow channel device guides the water so that the water flows from a back of the drum to the internal spaces of the plurality of balancers.

3. The laundry treatment apparatus of claim 1, wherein the plurality of balancers are spaced apart from a front end of the drum.

4. The laundry treatment apparatus of claim 1, wherein the plurality of balancers are formed in a front and rear direction of the drum.

5. The laundry treatment apparatus of claim 2, wherein the plurality of balancers are protruded in a direction opposite the centrifugal direction on an inner circumferential surface of the drum.

6. The laundry treatment apparatus of claim 5, wherein each of the balancers comprises an inclined portion in which a protrusion height of a rear end portion of the balancer is greater than a protrusion height of other portions of the balancer.

7. The laundry treatment apparatus of claim 1, wherein the plurality of balancers are spaced apart from each other at intervals of an identical angle around the rotation axis.

8. The laundry treatment apparatus of claim 1, wherein at least three balancers are spaced apart from each other by a specific angle around the rotation axis.

9. The laundry treatment apparatus of claim 1, wherein the partition comprises a vertical partition formed in a circumferential direction of the drum to divide the internal space of the balancer front and back and to have a termination spaced apart from an inside surface of the internal space of the balancer in a direction opposite the centrifugal direction.

10. The laundry treatment apparatus of claim 9, wherein the vertical partition includes a vertical partition groove formed in a centrifugal direction at the termination.

11. The laundry treatment apparatus of claim 1, wherein the partition comprises a lateral partition formed in a front and rear direction of the drum to divide the internal space of the balancer in a circumferential direction of the drum and to have a termination spaced apart from an inside surface of the internal space of the balancer in a direction opposite the centrifugal direction.

12. The laundry treatment apparatus of claim 11, wherein the lateral partition includes a lateral partition groove formed in the centrifugal direction at the termination.

13. The laundry treatment apparatus of claim 11, wherein the inflow channel device comprises a channel partition disposed on the plane on which the lateral partition is disposed to divide an inflow hole formed at a termination of a channel within the inflow channel device.

14. The laundry treatment apparatus of claim 2, further comprising:

an outflow channel to guide water so that the water flows out from the internal space of each balancer, wherein an outflow hole formed at a start end of the outflow channel is disposed in a direction opposite the centrifugal direction with respect to an inflow hole formed at a point into which water flows from the inflow channel device to the internal space of the balancer.

15. The laundry treatment apparatus of claim 14, wherein:

at least one balancer comprises an inclined portion protruded from an inner circumferential surface of the drum in the direction opposite the centrifugal direction such that a protrusion height of a rear end portion of the inclined portion is greater than a protrusion height of other portions of the balancer, a protrusion height of a rear end of the balancer is greater than a height from the inner circumferential surface of the drum to the outflow hole, and a protrusion height of a front portion of the inclined portion is less than a height from the inner circumferential surface of the drum to the outflow hole.

16. The laundry treatment apparatus of claim 1, wherein water drained through the outflow channel is discharged to a space between the drum and the tub.

* * * * *